US009808939B2

(12) United States Patent
Gutiérrez et al.

(10) Patent No.: US 9,808,939 B2
(45) Date of Patent: Nov. 7, 2017

(54) ASYMMETRICAL CUTTING TOOL HAVING DUAL ECCENTRIC THUMB STUDS

(76) Inventors: Santiago Gutiérrez, San Juan, PR (US); John David Broadwell, Wichita Falls, TX (US)

( * ) Notice: Subject to any disclaimer, the term of this patent is extended or adjusted under 35 U.S.C. 154(b) by 88 days.

(21) Appl. No.: 13/480,553

(22) Filed: May 25, 2012

(65) Prior Publication Data

US 2013/0312270 A1 Nov. 28, 2013

(51) Int. Cl.
*B26B 1/02* (2006.01)
*B26B 1/04* (2006.01)

(52) U.S. Cl.
CPC ..... *B26B 1/04* (2013.01); *B26B 1/044* (2013.01)

(58) Field of Classification Search
CPC ..... B26B 1/02; B26B 1/04
USPC ..... 30/151–164, 514
See application file for complete search history.

(56) References Cited

U.S. PATENT DOCUMENTS 1,386,956 A * 8/1921 Sanders ..... 30/342
4,266,591 A * 5/1981 F'Geppert ..... 411/167
4,272,887 A * 6/1981 Poehlmann ..... 30/161
5,331,741 A * 7/1994 Taylor, Jr. ..... 30/158
5,694,692 A * 12/1997 Reinschreiber ..... 30/155
6,101,723 A * 8/2000 Ford ..... 30/157
7,124,509 B1 * 10/2006 Hawk ..... 30/160
7,774,939 B1 * 8/2010 Onion ..... 30/161
8,468,701 B1 * 6/2013 Perez ..... 30/161
2006/0207102 A1 * 9/2006 Bezold ..... B26B 1/08 30/162
2010/0101100 A1 * 4/2010 Hansen et al. ..... 30/355
2011/0010949 A1 * 1/2011 Garrison ..... 30/279.2
2012/0304470 A1 * 12/2012 Freeman ..... B26B 1/046 30/159

* cited by examiner

*Primary Examiner* — Andrea Wellington
*Assistant Examiner* — Fernando Ayala
(74) *Attorney, Agent, or Firm* — Eugenio J. Torres; Oyola Victor Rodriguez; Reyes Ferraiuoli LLC

(57) ABSTRACT

An asymmetrical cutting tool has a partially cord-wrapped handle with a first handle panel, a second handle panel, and an intercheangeable overlay. The cutting tool further includes a folding blade, pivotably attached to the cord-wrapped/overlaid handle, and having a partially concave edge and a punch tip. The folding blade is operable to transition between a locked state and an unlocked state. Lock wear is compensated by dual eccentric thumb studs which act as a camshaft lobe to alter the position of the blade with respect to the lock while in the locked state. The partially cord-wrapped handle is configured to receive the folding blade when the blade transitions from the locked state into the unlocked state.

3 Claims, 10 Drawing Sheets

ASYMMETRICAL CUTTING TOOL HAVING DUAL ECCENTRIC THUMB STUDS

STATEMENT REGARDING FEDERALLY SPONSORED RESEARCH AND DEVELOPMENT

N/A

RELATED APPLICATIONS

N/A

BACKGROUND OF THE INVENTION

Field of the Invention

The present invention relates generally to the field of hardware tools, more particularly to a cutting tool having an asymmetrical handle and a pair of eccentric thumb studs.

Discussion of the Background

Cutting tools have been known to mankind for thousands of years. Among these cutting tools perhaps the most common is the knife, which at its basic form may include a blade with an edge and a contact portion, such as a handle. The earlier versions of the knife were made of stone and similar material. As humankind became more knowledgeable about materials and their characteristics, our tools have also increased in sophistication. For example, nowadays metal, alloys, and minerals have phased out the use of rocks and similar material in the construction of cutting tools and knives. In addition to metallic components, other resistant materials such as ceramics have been employed in the manufacture of knives.

Knives may be classified in two groups, depending on the configuration of its blade (i.e., whether it is fixed or pivotable) with respect to the handle. In the case of fixed-blade knives, as the name implies, the blade is permanently attached to the handle in a single position. In the folding knife's configuration, the blade is coupled to the handle by some mechanisms which ejects (or allows to be ejected) the blade from within the handle, exposing the edge of the knife. The ejection mechanism used in folding knives also varies. For example, some folding knives require the user to physically pull on some portion of the blade in order to expose and use the edge of the tool. However other knives employ configurations in which a user may activate a particular item, such as a screw or spring, thus causing the blade to deploy almost instantaneously.

Since folding knives typically pivot at an axis with respect to the handle, these do not maintain the same blade-handle alignment. Furthermore, it may be the case that a particular pivoting structure or a given ejection mechanism fails to provide adequate structural support for the knife when in use. While some folding knives may suffer from such shortcomings, this type of knife (in its non-deployed state) may represent a space-saving alternative for some customers, such as travelers or law enforcement.

For example, U.S. Pat. No. 5,819,414 discloses a folding knife in which the user is able to transition the blade from a sheathed position to a "locked use" position by either tactile manipulation of the blade by the user or by pressing a release button without touching the blade. Even though this particular folding knife may include alternative manipulation mechanisms, one important characteristic of prior art folding knives still remains: the shape (and thus the functionality) of the blade depends on the configuration of the handle, since the handle serves the purpose of securing and housing the blade.

Moreover, even with alternative manipulation mechanisms, folding knives may experience wear and tear of elements, such as the locking components. The severity of such wear and tear often depends on the blade-handle configuration chosen by the manufacturer. Accordingly, there is a need in the art for a tool which combines an asymmetrical handle, an adjustable support mechanism, and an adjustable blade stop to help offset the wear and tear typically associated with liner/frame locking folding knives.

SUMMARY OF THE INVENTION

In accordance with one aspect, the present disclosure is directed toward an asymmetrical folding knife including a partially cord-wrapped handle having a first handle panel and a second handle panel. The cutting tool further includes a folding blade, pivotably attached to the cord-wrapped handle, and having a curved edge and a punch tip. The handle also provides two tapped holes to instal an overlay instead of the cord wrapping. The folding blade is operable to transition between a locked state and an unlocked state by using a dual thumb stud configuration. While in the locked state, the folding blade is set into position employing eccentric thumb studs that double as stop pins. The dual eccentric thumb studs can be adjusted as desired, by rotating said thumb studs. The dual eccentric thumb studs retain the folding blade at variable positions by rotating on an offset axis. The partially cord-wrapped handle is configured to receive and lock the folding blade when the blade transitions from the unlocked stated into the locked state.

BRIEF DESCRIPTION OF THE DRAWINGS

The following drawings should be read with reference to the detailed description. Like numbers refer to like elements. The drawings, which are not necessarily to scale, illustratively depict embodiments of the present invention and are not intended to limit the scope of the invention.

DESCRIPTION OF THE PREFERRED EMBODIMENT

Figure 1A:
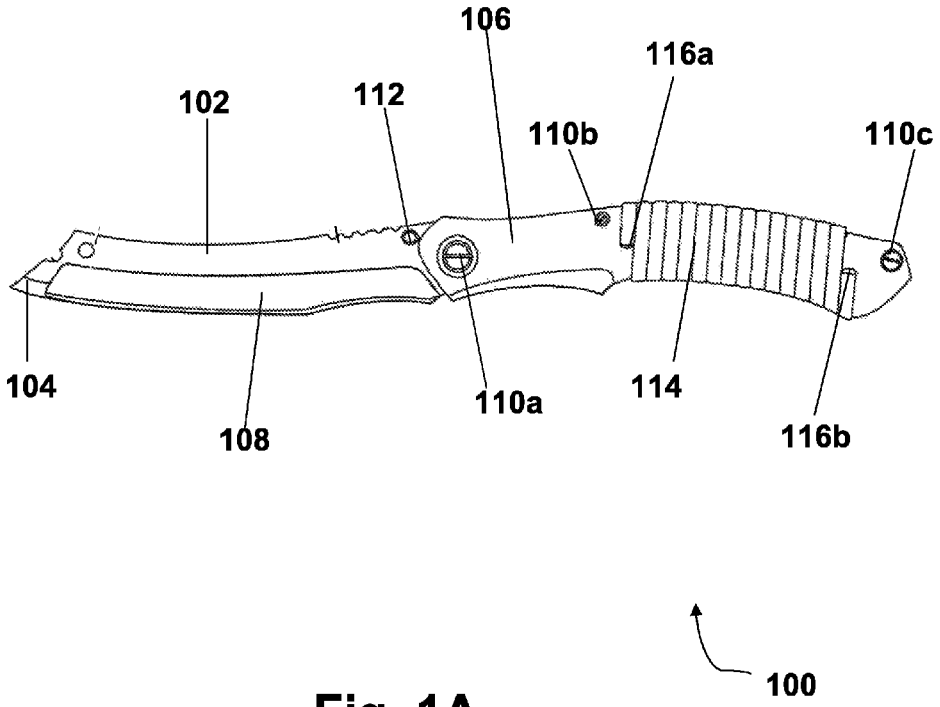
FIG. 1A shows a side-view (left side) of the cutting tool, according to a first embodiment of the present disclosure.

FIG. 1A discloses an embodiment of the present invention, which relates to a cutting tool, such as an asymmetrical folding knife 100, having an asymmetrical handle 106 and a multipurpose blade 102. The design of asymmetrical folding knife 100 incorporates a conventional frame lock side, and a cord-wrapped presentation side (e.g., handle 106). The multipurpose blade 102 transitions from an unlocked (closed) state to a locked (open) state by means of dual eccentric thumb studs 112. The dual eccentric thumb studs 112 further serve as stop pins once the blade is in the locked position, preventing the blade 102 from over-rotating and impacting the middle spacer 110*b*. Dual eccentric thumb studs 112 can also be adjusted by rotation to compensate for lock wear over time. The dual eccentric thumb studs retain the folding blade at variable positions by rotating on an offset axis. A separate, internal stop pin 801 is employed to stop blade 102 in the unlocked state, and prevent misalignment between blade 102 and the frame lock detent after adjustment to the dual eccentric thumb studs 112 is performed.

Handle 106 may include a partially cord-wrapped section, were an adjustable support mechanism 114 encloses either a right or a left handle panel. The adjustable support mechanism 114 may be removably attached to asymmetrical folding knife 100 using holes 116 and 106*a*. For example, depending on the particular task at hand, a user may select a particular type of material (e.g., rope or plastic) and secure the selected material to the body of handle 106 by inserting the ends of the support mechanism 114 through each of the holes 116*a* and 116*b*, and manually applying tensile force thereafter. It is contemplated, however, that adjustable support mechanism 114 may be permanently attached to handle 106 by securing the material 114 at holes 116*a* and 116*b* by melting, knotting or employing any similar technique known in the art.

In the embodiment shown in FIG. 1A, in order to attach the adjustable support mechanism 114, the handle 106 is partially milled inside for the full height of the material, and to any predetermined length, in order to allow the wrapping material to remain inlaid on the handle 106. By attaching an adjustable support mechanism 114 around a milled section of handle 106, the present disclosure prevents the blade 102 from coming in contact with the wrapping material when transitioning between the locked and unlocked states. Furthermore, the upper and lower edges along the milled area may be somewhat reduced, depending on the thickness of the wrapping material chosen by the user (in case the wrapping material is removable) or by the manufacturer (in case the wrapping material is permanently fixed).

It is further contemplated that the design of the present embodiment may be modified according to the particular needs of users. For example, a user may select to use removable elements, instead of applying tensile force or selecting a securing element to permanently affix the wrapping material. Such configurations may take advantage of the opportunity to quickly replace the wrapping material should it get damaged or simply reflect the practical or aesthetic preferences of the user. Several different wrapping techniques are feasible with the same type of wrapping material. Furthermore, it is contemplated that different types of wrapping material may be employed such as paracord, jute, vectran, and hemp, thus providing different alternatives in appearance, texture, and functionality.

Aside from the aesthetic aspect, partially wrapping a handle panel, such as the presentation side of the asymmetrical folding knife 100, as shown in the embodiment of FIG. 1A, may increase grip properties of the knife 100 when compared to a bare handle or a handle with conventional scales, regardless of the material used to make them. Therefore, a user (in case the wrapping material is removable) or by the manufacturer (in case the wrapping material is permanently fixed) may chose the wrapping technique and the wrapping material to obtain or approach the desired characteristics of the asymmetrical folding knife 100. Moreover, it is contemplated that a user or manufacturer may combine more than one material when wrapping the handle 106. That is, the adjustable support mechanism 114 may comprise different wrapping materials, even if on a single handle 106. As an example, a user may start with a particular thread, then tie one or more different materials at certain points during wrapping in such manner that, when the wrapping thread reaches hole 116*a*, it shows a different material than the one used to lock the adjustable support mechanism 114 in hole 116*b*, or viceversa.

As seen in FIG. 1A, the partially cord-wrapped handle 106 may accommodate a folding blade 102. An internal stop pin 801 may prevent the blade 102 from inserting itself excessively into the handle 106 when in the unlocked state. Handle 106 is held in place by a pivot screw 110*a*, middle spacer 110*b* and back spacer 110*c*. Blade 102 has multiple grinds and a partially concave edge nearest to the choil area. The blade 102 ends with a punch tip 104. The punch tip 104 is thicker than the primary grind 108 of blade 102, thus defining a cutting wedge while allowing the knife 100 to exhibit more strength up front. Furthermore, even though the general profile of the blade 102 shows a cleaver design, the lower half of the tip 104 may be configured in such a way as to be pointed enough to pierce through certain materials without damage. It is contemplated that the punch tip 104 may include different configurations, in addition to the one illustrated in FIG. 1A and subsequent illustrations.

Figure 1B:
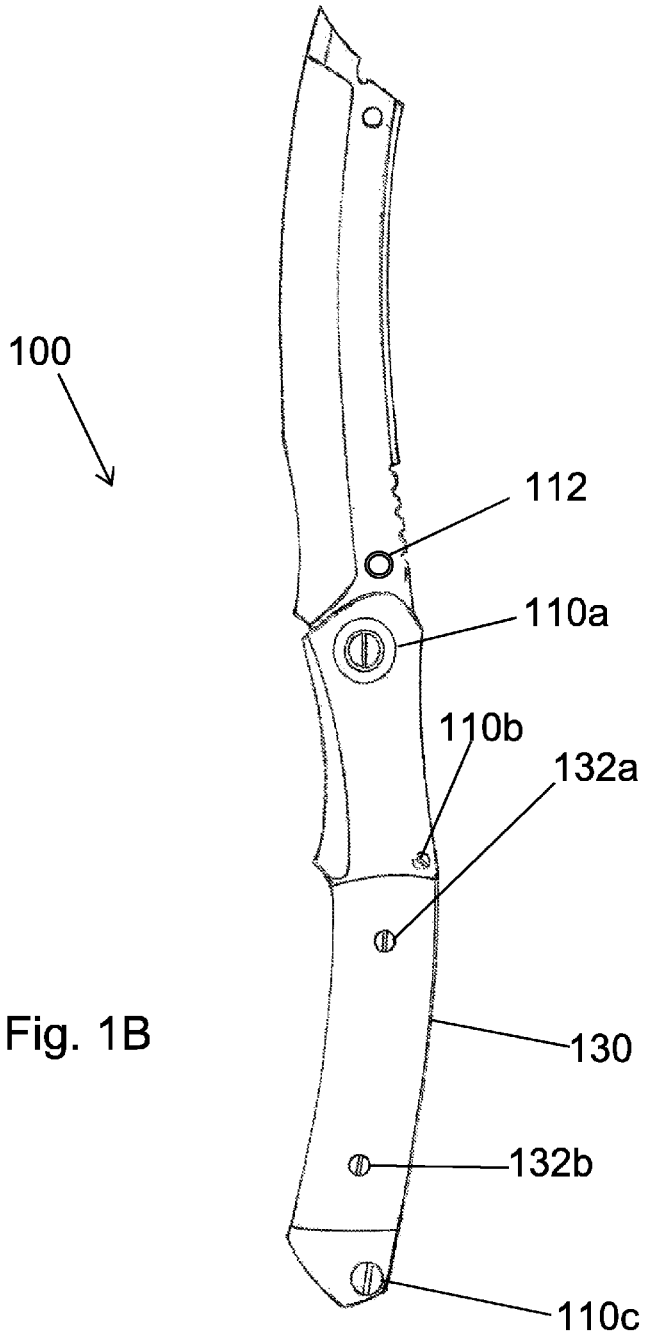
FIG. 1B shows a side view (left side) of the cutting tool with an overlay installed, according to an embodiment of the present disclosure.

Alternatively, the presentation side can incorporate an overlay 130 which can be made of different materials, as shown in FIG. 1B. The overlaid material 130 may be attached to the left handle panel with microscrews by means of drilled and tapped holes 132*a* and 132*b* on said handle panel. The tapped holes 132*a* and 132*b* are concealed under the wrapping material 114 when such method is employed. Conversely, holes 116*a* and 116*b* would be concealed under the overlay 130 once it is installed.

Although in the embodiments shown on FIG. 1A and FIG. 1B, the adjustable support mechanism 114 and overlay 130 only go around the presentation side panel (i.e., left panel) of handle 106, it is contemplated that the presentation side and the cord-wrapping (or overlay) may be located on either panel of handle 106.

Figure 2:
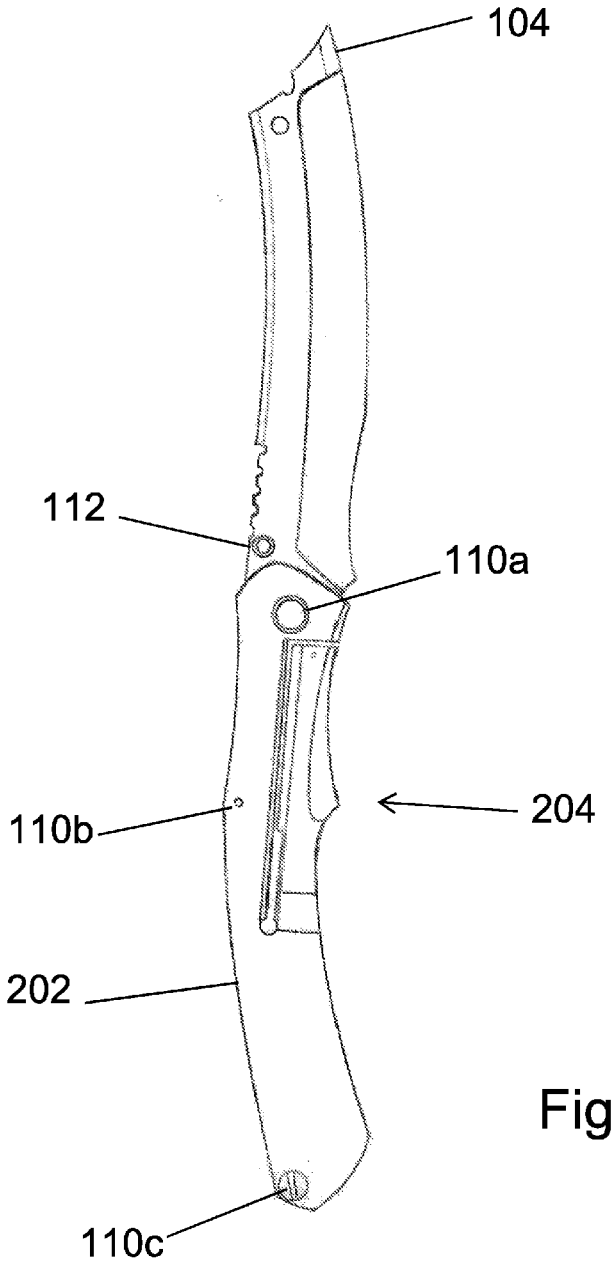
FIG. 2 shows a side view (right side) of the cutting tool according to an embodiment of the present disclosure.

FIG. 2 illustrates a right handle panel 202 of the asymmetrical folding knife 100 shown in FIG. 1A, according to an embodiment of the present disclosure. A conventional frame lock 204 is employed to secure the blade 102 in the locked position, after which it is set in said locked position by dual eccentric thumb studs 112. As with conventional frame lock designs, the blade 102 is also maintained in the unlocked state by an internal stop pin 801, and a ball detent (not shown) embedded into the frame lock 204 that inserts into a round hole on the tang of blade 102. The ball detent is kept in place by the pressure exerted by the frame lock 204.

Figure 3:
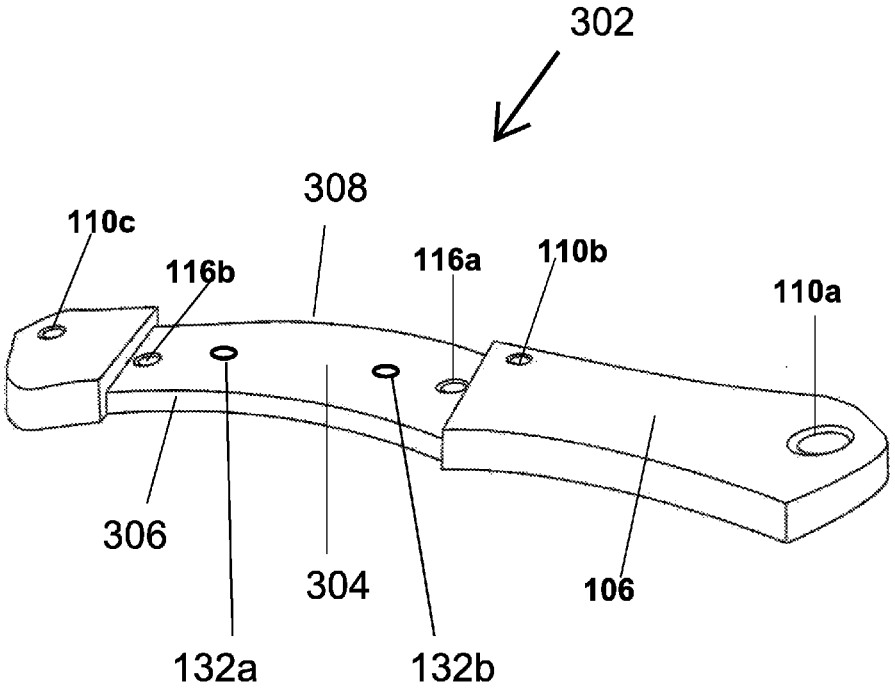
FIG. 3 shows the left handle panel of the cutting tool shown in FIG. 1A, according to an embodiment of the present disclosure.

FIG. 3 illustrates a left handle panel 302 of the asymmetrical folding knife 100 shown in FIG. 1A, according to an embodiment of the present disclosure. As shown by the milled surface 304, the handle 106 may be partially milled for the full height of the wrapping material, and to any predetermined length, in order to allow the wrapping material to remain inlaid on the handle 106 and, thus, prevent the blade 102 from deteriorating the wrapping material due to the friction when locking and unlocking the blade 102 within handle 106. Additionally, the upper and lower edges (308 and 306, respectively) along the milled surface 304 are also milled, depending on the thickness of the wrapping material selected and in order to prevent this material from bulging up. As disclosed earlier, the milling of surface 304 and edges 306, 308 may be to the extent and depth necessary according to the thickness of the material of handle 106 used and/or the wrapping material used for the adjustable support mechanism 114. Drilled and tapped screw holes 132*a* and 132*b* to secure an overlay 130 in lieu of the cord-wrapping are also illustrated in FIG. 3.

Figure 4A:
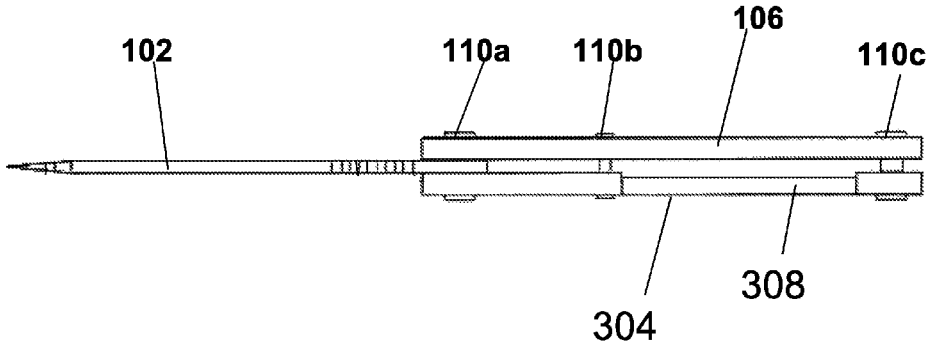
FIG. 4A shows a top-view of the cutting tool without an adjustable support mechanism, according to an embodiment of the present disclosure.

FIG. 4A illustrates a top-view of a cutting tool, such as asymmetrical folding knife 100, without an adjustable support mechanism 114, according to an embodiment of the present disclosure. As it may be appreciated from FIG. 4A, one of the panels of handle 106 may be milled, as to reduce the thickness in an area approximately corresponding to the location of the adjustable support mechanism 114.

Figure 4B:
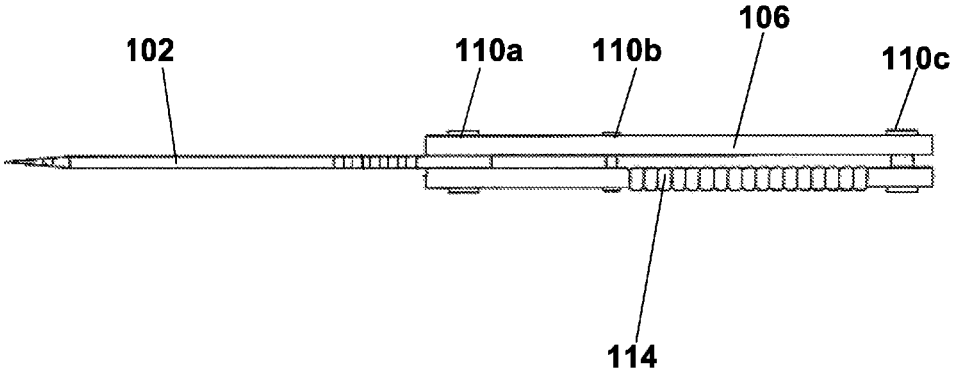
FIG. 4B shows a top-view of the cutting tool including an adjustable support mechanism, according to an embodiment of the present disclosure.

FIG. 4B also illustrates a top-view of a cutting tool according to an embodiment of the present disclosure, such as asymmetrical folding knife 100, but in this case having an adjustable support mechanism 114. As it may be appreciated from FIG. 4B, one of the panels of handle 106 may be partially milled, in order to reduce the thickness in an area approximately corresponding to the location of the adjustable support mechanism 114. The length and depth of the milled section may be chosen such that, once the wrapping material is applied to the handle 106, the inner surface of the handle panel is even with the non-milled portion of the handle. As illustrated in FIG. 4B, the blade 102 may fold about pivot element 110*a* and back into the handle 106.

Figure 5:
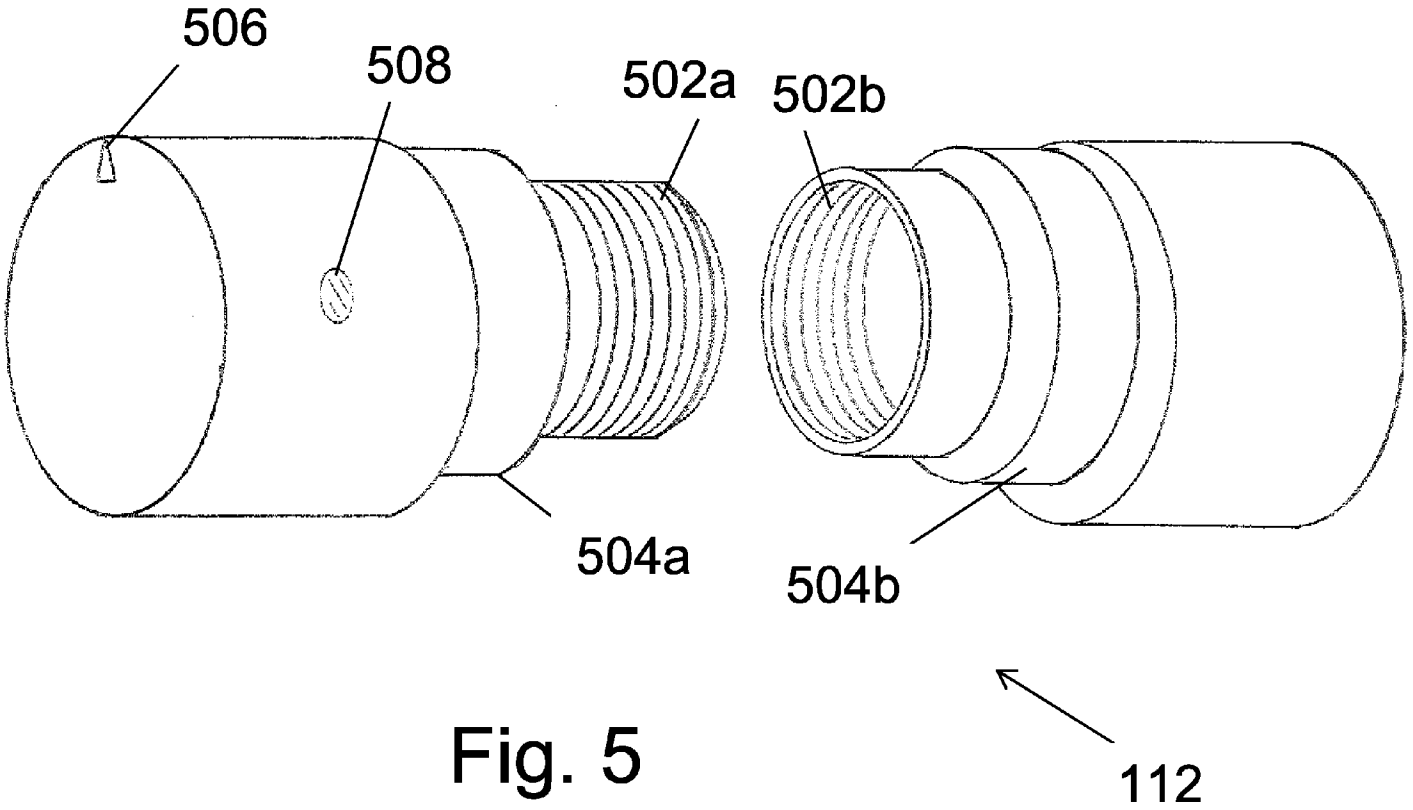
FIG. 5 illustrates a detailed view of the dual eccentric thumb studs depicted in FIGS. 1A, 1B, and 2, according to an embodiment of the present disclosure.
Figure 6A:
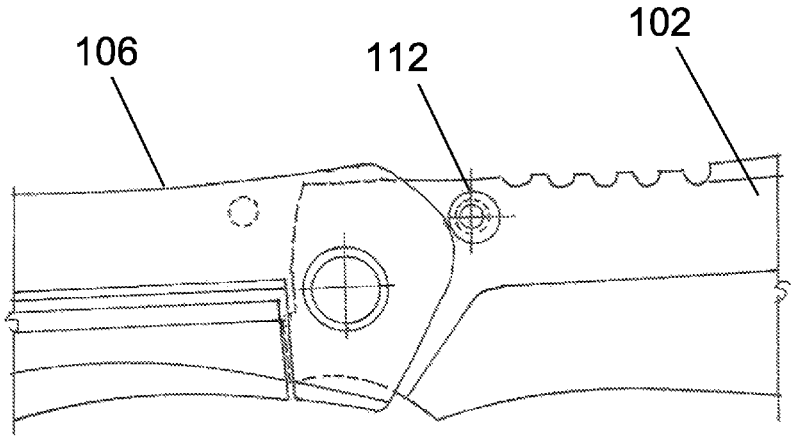
FIGS. 6A-6C show a side view of the cutting tool, according to an embodiment of the present disclosure.
Figure 6B:
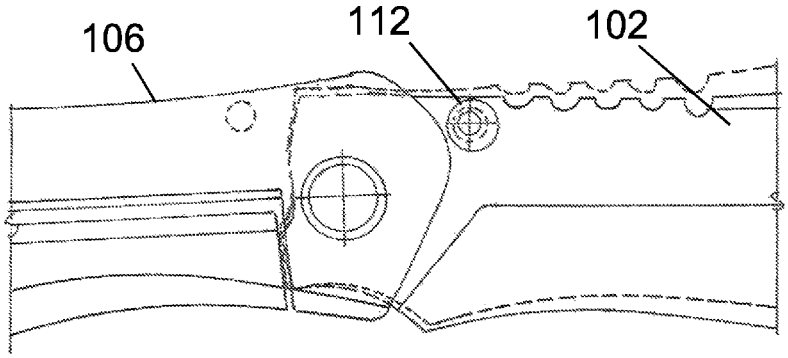
Figure 6C:
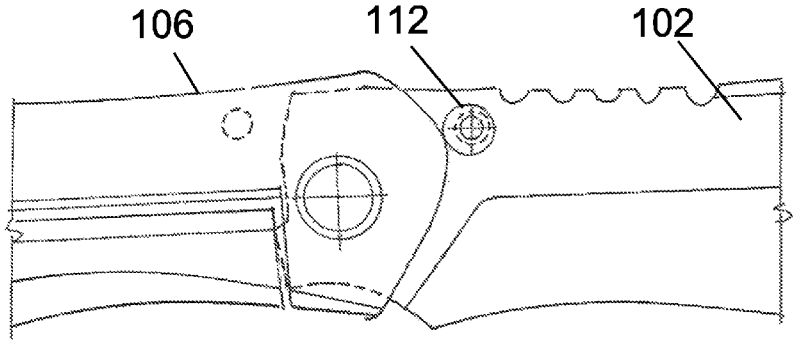
Figures 7A, 7B, 7C:
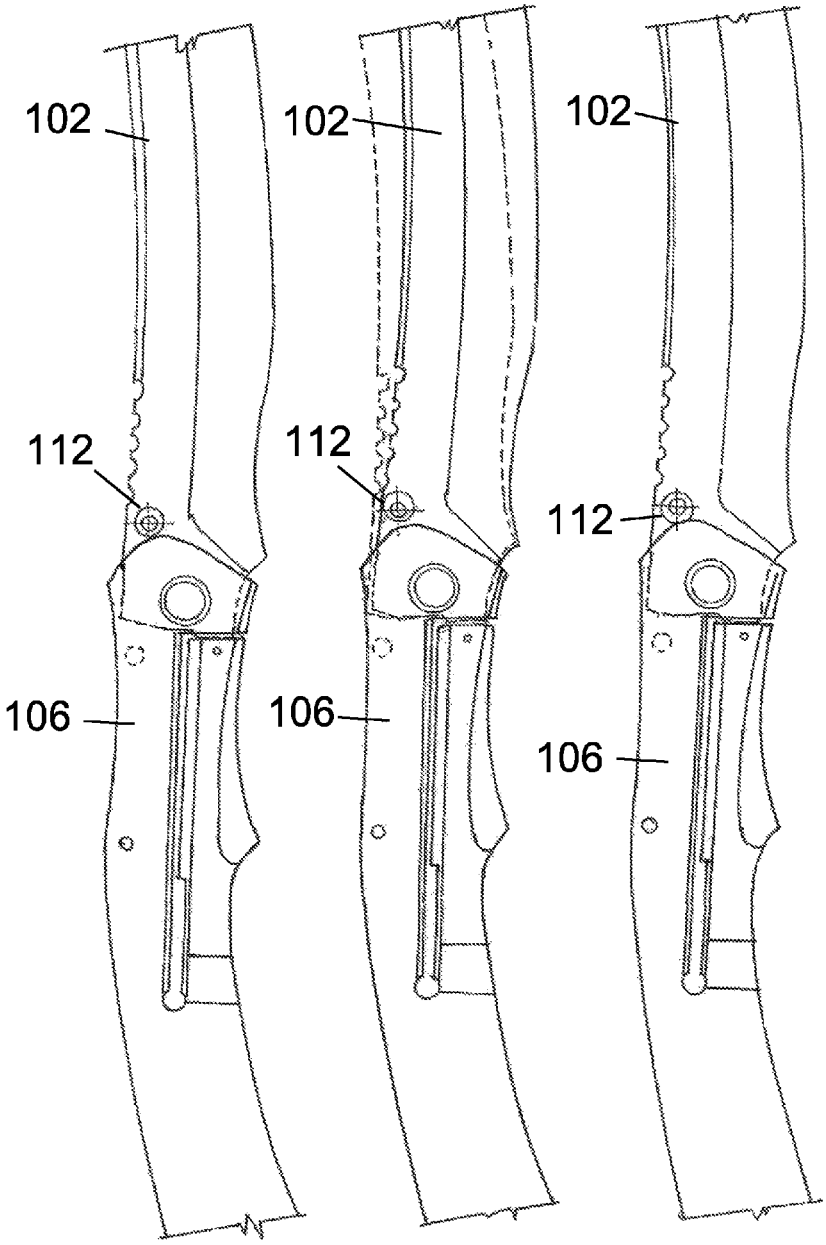
FIGS. 7A-7C show a side view of the cutting tool, according to an embodiment of the present disclosure.
Figure 8A:
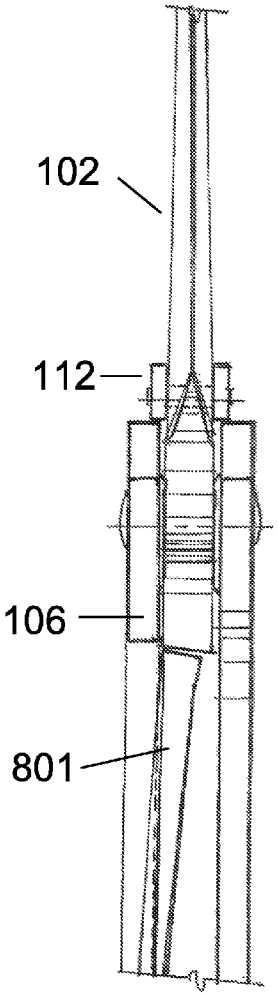
FIG. 8A-8C show a front view of the cutting tool, according to an embodiment of the present disclosure.
Figure 8B:
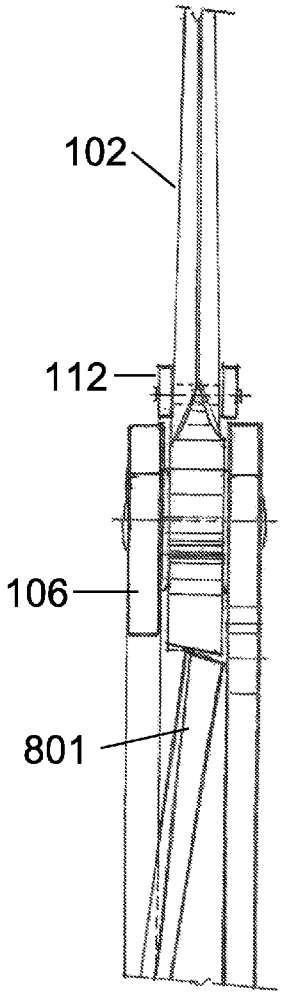
Figure 8C:
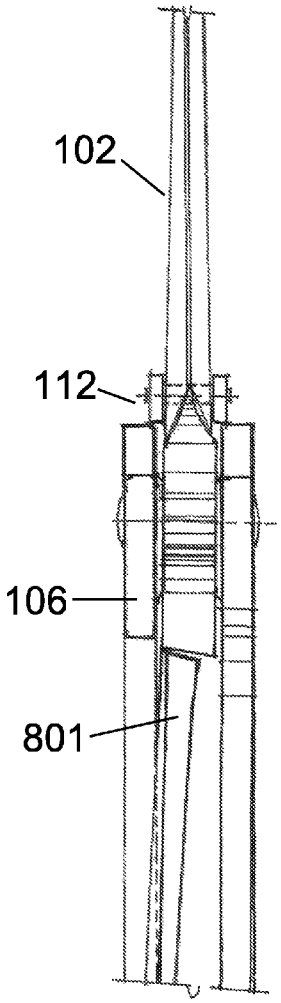

FIG. 5 illustrates the dual eccentric thumb studs 112. As previously described, the asymmetrical folding knife 100 locks open by employing a frame lock 204 at the second handle panel. The lock consists of a spring-loaded bar cut in the handle panel of which the open end sets behind the blade 102 tang in the locked state, preventing the blade 102 from closing unless pressure to the bar is applied in the opposite direction. The dual eccentric thumb studs 112 keep the blade 102 locked at a predetermined position, preventing it from rotating all the way to the back of handle 106.

A traditional stop pin is a round rod inlaid in a folding knife's handle at a specific position that stops the blade in the locked position and allows the lock bar to exert pressure on the blade's tang. The more pressure is exerted, the tighter and more secure the lock is. However, pressure from the lock bar creates wear on the lock bar's surface and on the blade's tang. The foregoing causes the lock bar to progressively travel into the handle 106, wearing, and therefore, gradually weakening the lock mechanism.

The dual eccentric thumb studs 112 essentially act similar to a lobe on an automobile camshaft. For example, the asymmetrical shape of a lobe on an automobile camshaft causes the valves in such a motor to open and close as the camshaft rotates. Applying a similar principle, as shown in FIGS. 6A-6C, 7A-7C, and 8A-8C, the dual eccentric thumb studs 112 are mechanically coupled as to rotate offset with respect to their axis. The dual eccentric thumb studs 112 may compensate for the loss and wear of material occurring between the lock and the tang. Thus, the dual eccentric thumb studs 112 may effectively offset loss and wear on the lock mechanism. To achieve the necessary asymmetry, as shown in FIG. 5, threaded ends 502*a*, 502*b* of the dual eccentric thumb studs 112 may be reduced in diameter at an off-center position with respect to the larger round surface that make contact with the front of the handle 106. The configuration shown in FIG. 5 is an exemplary embodiment and, thefore, it is contemplated that the specific degree of asymmetry may vary depending on the dimensions of the knife 100.

The dual eccentric thumb studs 112 may be screwed together through a counter bored hole drilled on both sides of blade 102. Sections 504*a* and 504*b* of the dual eccentric thumb studs 112 get inlaid at the counter bored hole on the blade 102 and prevent it from moving out of position after installation. A position marker 506 in the form of a dot, arrow, or any other shape, may be milled on one or both dual eccentric thumb studs 112 to show a minimum and/or maximum degree of adjustment. One adjustment hole 508 may be drilled on one or both dual eccentric thumb studs 112 for insertion of any round instrument with an adequate diameter to aid in loosing thread lock for removal or to calibrate the lock adjustment. As shown in FIGS. 6A-6C, 7A-7C, and 8A-8C, rotating the dual eccentric thumb studs 112 will make blade 102 stop earlier against the front of handle 106 by gradually decreasing the distance traveled by the blade 102. Consequently, a strong, early locking action can be maintained for a longer period of time, despite surface wear on both the lock mechanism and the blade 102.

Contrary to conventional stop pins, the dual eccentric thumb studs 112 do not serve the dual function of stopping the blade 102 in both locked and unlocked states. As shown in FIGS. 6A-6C, 7A-7C, and 8A-8C, the dual eccentric thumb studs 112 only make contact with the blade 102 while in the locked state. An internal stop pin 801 inlaid on both panels of handle 106 stops the blade 102 while in the unlocked state. The foregoing may help avoid any misalignment between the frame lock ball detent and the receiving cavity on the blade 102 tang, while in the unlocked state, that otherwise may be caused by an adjustment to the dual eccentric thumb studs 112.

While the disclosure has been described as having a preferred design, it is understood that many changes, modifications, variations and other uses and applications of the subject invention will, however, become apparent to those skilled in the art without materially departing from the novel teachings and advantages of this invention after considering this specification together with the accompanying drawings. For example, it is contemplated that the handle 106, the blade 102, the dual eccentric thumb studs 112, and the adjustable support mechanism 114 may be comprised of any material known in the art which may be suitable for the purposes and functionalities disclosed herein.

Accordingly, all such changes, modifications, variations and other uses and applications which do not depart from the spirit and scope of the invention are deemed to be covered by this invention as defined in the following claims and their legal equivalents. In the claims, means-plus-function clauses, if any, are intended to cover the structures described herein as performing the recited function and not only structural equivalents but also equivalent structures.

All of the patents, patent applications, and publications recited herein, and in the Declaration attached hereto, if any, are hereby incorporated by reference as if set forth in their entirety herein. All, or substantially all, the components disclosed in such patents may be used in the embodiments of the present invention, as well as equivalents thereof. The details in the patents, patent applications, and publications incorporated by reference herein may be considered to be incorporable at applicant's option, into the claims during prosecution as further limitations in the claims to patentably distinguish any amended claims from any applied prior art.

The invention claimed is:

1. An asymmetrical cutting tool, comprising:

a handle comprising a first handle panel and a second handle panel, wherein the first handle panel comprises a frame lock;

a folding blade, pivotally attached to the handle, and comprising a partially concave edge and a punch tip; and an adjustable dual eccentric thumb stud comprising a fixed rotational axis, a first thumb stud and a second thumb stud, the first thumb stud comprising a first distal surface and a first proximal threaded end and the second thumb stud comprising a second distal surface and a second proximal threaded end, wherein the first proximal threaded end can engage with the second proximal threaded end as part of a single fastening mechanism, wherein the first proximal threaded end and the second proximal threaded end are reduced in diameter with respect to the first distal surface and the second distal surface and placed at an off-center position with respect to the first distal surface and the second distal surface, wherein the first thumb stud and the second thumb stud are mechanically coupled to rotate about a fixed axis that is central to the first and second proximal threaded ends, and the first and second distal surfaces rotate about the fixed axis but at a position offset from the center of the fixed axis, wherein the adjustable dual eccentric thumb stud is located within the folding blade and is configured to retain the folding blade in a predetermined position, wherein the handle is configured to receive the folding blade.

2. An asymmetrical cutting tool, comprising:

a handle comprising a first handle panel and a second handle panel, wherein the first handle panel comprises a frame lock;

a folding blade, pivotally attached to the handle, and comprising a partially concave edge and a punch tip; and a rotating dual eccentric thumb stud comprising a fixed rotation axis, a first thumb stud and a second thumb stud, the first thumb stud comprising a first distal surface and a first proximal threaded end and the second thumb stud comprising a second distal surface and a second proximal threaded end, wherein the first proximal threaded end can engage with the second proximal threaded end as part of a single fastening mechanism, wherein the first proximal threaded end and the second proximal threaded end is are reduced in diameter with respect to the first distal surface and the second distal surface and placed at an off-center position with respect to the first distal surface and the second distal surface, wherein the first thumb stud and the second thumb stud are mechanically coupled to rotate about a fixed axis that is central to the first and second proximal threaded ends, and the first and second distal surfaces rotate about the fixed axis but at a position offset from the center of the fixed axis, wherein the rotating dual eccentric thumb stud is located within the folding blade and is configured to retain the folding blade in a predetermined position, wherein the handle is configured to receive the folding blade.

3. An asymmetrical cutting tool, comprising:

a handle comprising a first handle panel and a second handle panel, wherein the first handle panel comprises a frame lock, wherein the handle is configured to interchangeably operate in one of two states;

a folding blade, pivotally attached to the handle, the folding blade comprising a partially concave edge and a punch tip; and a pair of continuously adjustable eccentric thumb studs comprising a fixed rotational axis, a first thumb stud and a second thumb stud, the first thumb stud comprising a first distal surface and a first proximal threaded end and the second thumb stud comprising a second distal surface and a second proximal threaded end wherein the first proximal threaded end can engage with the second proximal threaded end as part of a single fastening mechanism, wherein the first proximal threaded end and the second proximal threaded end are reduced in diameter with respect to the first distal surface and the second distal surface and placed at an off-center position with respect to the first distal surface and the second distal surface, wherein the first thumb stud and the second thumb stud are mechanically coupled to rotate about a fixed axis that is central to the first and second proximal threaded ends, and the first and second distal surfaces rotate about the fixed axis but at a position offset from the center of the fixed axis, wherein the pair of continuously adjustable eccentric thumb stud is located within the folding blade and is configured to retain the folding blade in a predetermined position, wherein the handle is configured to receive the folding blade.

* * * * *